US010420979B2

(12) United States Patent
Estrada, Jr. et al.

(10) Patent No.: US 10,420,979 B2
(45) Date of Patent: Sep. 24, 2019

(54) MODULAR FITNESS SYSTEM AND METHODS OF USE

(71) Applicant: Destined Enterprises Inc., El Segundo, CA (US)

(72) Inventors: Marco Estrada, Jr., El Segundo, CA (US); Marco Estrada, Sr., El Segundo, CA (US)

(73) Assignee: Destined Enterprises Inc., El Segundo, CA (US)

( * ) Notice: Subject to any disclaimer, the term of this patent is extended or adjusted under 35 U.S.C. 154(b) by 102 days.

(21) Appl. No.: 15/579,165

(22) PCT Filed: Jun. 1, 2016

(86) PCT No.: PCT/US2016/035238

§ 371 (c)(1),
(2) Date: Dec. 1, 2017

(87) PCT Pub. No.: WO2016/196613

PCT Pub. Date: Dec. 8, 2016

(65) Prior Publication Data

US 2018/0126213 A1 May 10, 2018

Related U.S. Application Data

(60) Provisional application No. 62/171,930, filed on Jun. 5, 2015.

(51) Int. Cl.
*A63B 21/055* (2006.01)
*A63B 21/00* (2006.01)
(Continued)

(52) U.S. Cl.
CPC ..... *A63B 21/4035* (2015.10); *A63B 21/002* (2013.01); *A63B 21/0004* (2013.01);
(Continued)

(58) Field of Classification Search
None
See application file for complete search history.

(56) References Cited

U.S. PATENT DOCUMENTS 3,892,084 A * 7/1975 Hanysz ..... A63B 19/00 446/411
4,915,666 A * 4/1990 Maleyko ..... A63B 19/00 446/242

(Continued)

FOREIGN PATENT DOCUMENTS

EP 1338308 A1 8/2003

OTHER PUBLICATIONS

International Search Report and Written Opinion, PCT/US2016/035238, dated Sep. 14, 2016.

*Primary Examiner* — Stephen R Crow
(74) *Attorney, Agent, or Firm* — Entralta P.C.; Justin G. Sanders; Peter D. Weinstein

(57) ABSTRACT

A modular fitness system and associated methods of use are disclosed. In at least one embodiment, the system provides a plurality of elongate weighted segments, and a plurality of handle links sized and configured for accommodating a hand of a user. The segments and handle links are removably engagable with one another in series so as to form an exercise structure. Thus, the user is capable of selectively engaging at least one of the segments having a desired weight with at least one of the handle links in order to form an appropriate configuration of the exercise structure for performing one or more desired exercises therewith.

16 Claims, 8 Drawing Sheets

(51) Int. Cl.

| | |
|---|---|
| ***A63B 23/035*** | (2006.01) |
| ***A63B 21/002*** | (2006.01) |
| ***A63B 21/06*** | (2006.01) |
| ***A63B 21/072*** | (2006.01) |
| ***A63B 23/12*** | (2006.01) |
| ***A63B 21/04*** | (2006.01) |
| *A63B 23/04* | (2006.01) |

(52) U.S. Cl.

CPC .. *A63B 21/00047* (2013.01); *A63B 21/00061* (2013.01); *A63B 21/00185* (2013.01); *A63B 21/00189* (2013.01); *A63B 21/0428* (2013.01); *A63B 21/0552* (2013.01); *A63B 21/0557* (2013.01); *A63B 21/0601* (2013.01); *A63B 21/0602* (2013.01); *A63B 21/0603* (2013.01); *A63B 21/0724* (2013.01); *A63B 21/4043* (2015.10); *A63B 23/03516* (2013.01); *A63B 23/03558* (2013.01); *A63B 23/1236* (2013.01); *A63B 23/1272* (2013.01); *A63B 23/1281* (2013.01); *A63B 2023/0411* (2013.01); *A63B 2209/00* (2013.01); *A63B 2210/50* (2013.01); *A63B 2225/09* (2013.01)

(56) References Cited

U.S. PATENT DOCUMENTS

| | | | | |
|---|---|---|---|---|
| 5,338,244 | A | 8/1994 | Huang | |
| 6,309,273 | B1 | 10/2001 | Kim | |
| 6,431,939 | B1 * | 8/2002 | Roh | A61H 7/00 446/236 |
| 6,814,645 | B2 * | 11/2004 | Kuk | A63B 19/00 446/236 |
| 7,780,501 | B2 * | 8/2010 | Kim | A63H 33/02 446/236 |
| 8,342,901 | B1 * | 1/2013 | Deluz | A63B 19/00 446/175 |
| 9,302,194 | B2 * | 4/2016 | Hsu | A63H 33/00 |
| 9,468,790 | B1 * | 10/2016 | Snead | A63B 21/0608 |
| 2009/0017719 | A1 | 1/2009 | Lin | |
| 2011/0092347 | A1 | 4/2011 | Kassel | |
| 2014/0309088 | A1 | 10/2014 | Buikema | |
| 2018/0008854 | A1 * | 1/2018 | Brown | A63B 19/00 |
| 2018/0085619 | A1 * | 3/2018 | Chen | A63B 21/0603 |
| 2018/0326318 | A1 * | 11/2018 | Blumenfeld | A63H 33/18 |

* cited by examiner

MODULAR FITNESS SYSTEM AND METHODS OF USE

RELATED APPLICATIONS

This application is a 35 U.S.C. § 371 US national stage entry of International Application number PCT/US2016/035238, filed Jun. 1, 2016, and claims priority and is entitled to the filing date of U.S. provisional application Ser. No. 62/171,930, filed Jun. 5, 2015. The contents of the aforementioned applications are incorporated herein by reference.

BACKGROUND

The subject of this provisional patent application is a fitness system, particularly a modular fitness system, and associated methods of use, capable of being selectively arranged and configured for allowing a user to engage in a wide variety of fitness-related exercises.

Applicant(s) hereby incorporate herein by reference any and all patents and published patent applications cited or referred to in this application.

By way of background, time limitations created by everyday life tend to make it difficult for many people to find opportunities to exercise. Additionally, comprehensive conditioning of the human body has traditionally required numerous, and often large, exercise devices. These devices are typically large, heavy and expensive and, thus, are usually located in health clubs, gyms and the like. As such, users of such devices must make the added effort of travelling to such locations in order to exercise. Thus, there remains a need for a relatively compact exercise device, or system, capable of allowing a user to engage in a wide variety of fitness-related exercises wherever it might be convenient.

Aspects of the present invention fulfill these needs and provide further related advantages as described in the following summary.

SUMMARY

Aspects of the present invention teach certain benefits in construction and use which give rise to the exemplary advantages described below.

The present invention solves the problems described above by providing a modular fitness system and associated methods of use. In at least one embodiment, the system provides a plurality of elongate weighted segments, and a plurality of handle links sized and configured for accommodating a hand of a user. The segments and handle links are removably engagable with one another in series so as to form an exercise structure. Thus, the user is capable of selectively engaging at least one of the segments having a desired weight with at least one of the handle links in order to form an appropriate configuration of the exercise structure for performing one or more desired exercises therewith.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

The above described drawing figures illustrate aspects of the invention in at least one of its exemplary embodiments, which are further defined in detail in the following description. Features, elements, and aspects of the invention that are referenced by the same numerals in different figures represent the same, equivalent, or similar features, elements, or aspects, in accordance with one or more embodiments.

DETAILED DESCRIPTION

Figure 1:
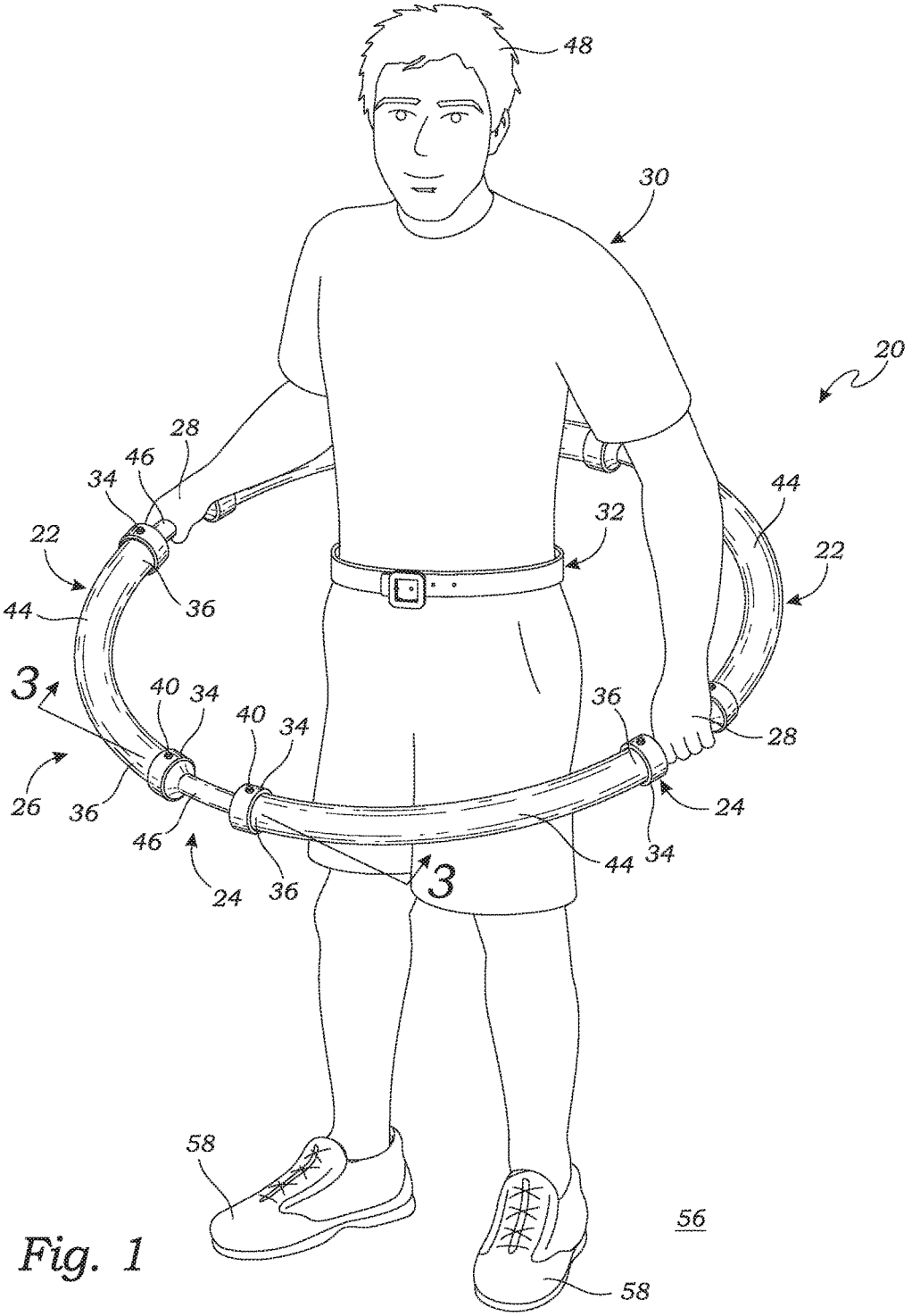
FIG. 1 is a perspective view of an exemplary modular fitness system, in accordance with at least one embodiment.
Figure 2:
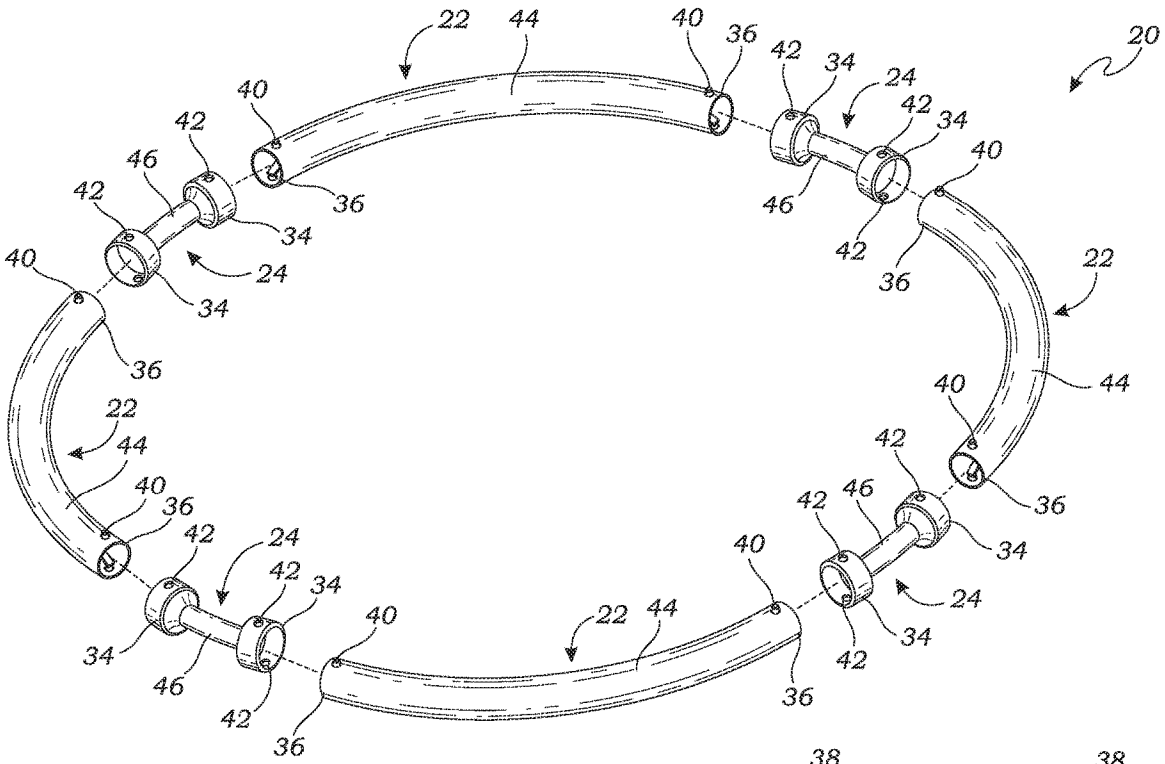
FIG. 2 is an exploded view thereof, in accordance with at least one embodiment.

Turning now to FIG. 1, there is shown a perspective view of an exemplary embodiment of a modular fitness system 20. As illustrated in the exploded view of FIG. 2, the system 20 comprises, in at least one embodiment, a plurality of elongate weighted segments 22 and a plurality of handle links 24 configured for being removably engagable with at least one of the segments 22 in series, thereby forming an exercise structure 26. As illustrated in FIG. 1, in at least one embodiment, the segments 22 and handle links 24 are sized and shaped for being selectively engaged with one another in alternating series such that the resulting exercise structure 26 is ring-shaped. It should be noted at the outset that the term "ring" is intended to generally mean any exercise structure having a substantially continuous shape—i.e., circle, square, rectangle, triangle, pentagon, octagon, etc.—whether symmetrical or not. Additionally, while the accompanying drawings illustrate the exemplary system 20 as comprising a set of four segments 22 and four handle links 24, in further embodiments, the system 20 may comprise any number and combination of segments 22 and handle links 24 so as to be capable of selectively forming a substantially ring-shaped exercise structure 26 when removably engaged with one another in series; thus, the present invention should not be read as being so limited.

With continued reference to FIG. 1, in at least one embodiment, each of the handle links 24 is sized and configured for accommodating a hand 28 of a user 30. Additionally, in at least one embodiment, when the segments 22 and handle links 24 are engaged so as to form a ring-shaped exercise structure 26, the exercise structure 26 is sized for allowing the user 30 to grasp opposing handle links 24 and hold the exercise structure 26 substantially around their waist 32, the purpose for which is discussed further below.

Figure 3:
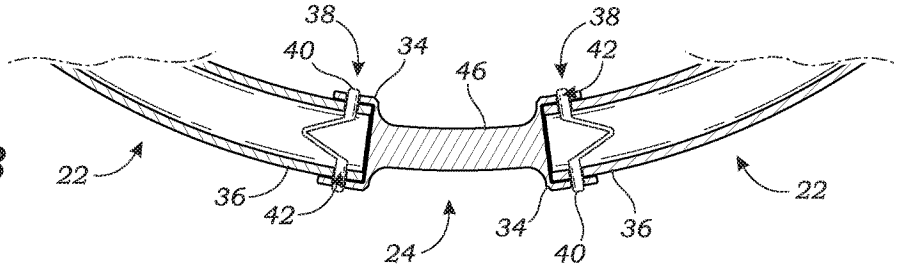
FIG. 3 is a cross-sectional view taken along line 3-3 of FIG. 1, in accordance with at least one embodiment.

As illustrated in the cross-sectional view of FIG. 3, in at least one embodiment, each handle link 24 provides opposing handle ends 34 and each segment 22 provides opposing segment ends 36. In at least one such embodiment, each handle end 34 is open and sized for approximating an outer diameter of the segment end 36 of one of the segments 22, thereby allowing the segment end 36 to be selectively inserted within the handle end 34. Additionally, in at least one embodiment, the handle ends 34 and segment ends 36 provide complementary engagement mechanisms 38 for preventing the handle ends 34 and corresponding segment ends 36 from being unintentionally disengaged from one another. In at least one such embodiment, as illustrated best in FIG. 3, the engagement mechanisms 38 comprise an at least one spring-biased pin 40 positioned within each segment end 36 and configured for selectively indexing into a corresponding at least one pin aperture 42 positioned on each handle end 34. It should be noted that the spring-biased pins 40 and corresponding pin apertures 42 are intended to simply illustrate one type of exemplary engagement mechanism 38. In further embodiments, any other engagement mechanisms 38—now known or later developed—capable of preventing the handle ends 34 and corresponding segment ends 36 from being unintentionally disengaged from one another may be substituted. In at least one alternate embodiment, each segment end 36 is open and sized for approximating an outer diameter of the handle end 34 of one of the handle links 24, thereby allowing the handle end 34 to be selectively inserted within the segment end 36. Additionally, in at least one such alternate embodiment, the at least one spring-biased pin 40 is positioned within each handle end 34 and configured for selectively indexing into a corresponding at least one pin aperture 42 positioned on each segment end 36. In still further embodiments, any other configuration for allowing the handle ends 34 and segment ends 36 to be removably engaged with one another—now known or later developed—may be substituted. In yet still further embodiments, the handle links 24 are sized and shaped for being selectively engaged with another handle link 24 (while still being selectively engagable with segments 22), and the segments 22 are sized and shaped for being selectively engaged with another segment 22 (while still being selectively engagable with handle links 24), thereby allowing the user 30 to create exercise structures 26 that incorporate adjacently (i.e., consecutively) engaged handle links 24 and/or adjacently engaged segments 22 as desired.

As mentioned above, each of the segments 22 is weighted, the purpose for which is discussed further below. In at least one embodiment, each of the segments 22 is constructed of a material—or combination of materials—of appropriate weight, such as metal, steel, lead, iron, plastic, rubber or any other material having sufficient weight, now known or later developed. In at least one such embodiment, each segment 22 is made to have appropriate dimensions and thickness so as to achieve the desired weight, depending on the material or materials of construction. In at least one other embodiment, each of the segments 22 is at least partially hollow and configured for receiving a weighted material—or combination of materials—such as sand, water, or any other material having sufficient weight, now known or later developed. In at least one such embodiment, the weighted material is removable, thereby allowing the user 30 to selectively increase or decrease the weight of a given segment 22. In at least one still further embodiment (not shown), each of the segments 22 is configured for removably receiving an at least one internal weight, thereby allowing the user 30 to selectively increase or decrease the weight of a given segment 22. In at least one such embodiment, each of the segments 22 is configured for being selectively opened, thus allowing for the insertion and/or removal of the at least one internal weight. Similar to the segments 22 themselves, the at least one internal weight may achieve the desired weight using any of the same structural configurations and/or materials of construction discussed above. In still further embodiments (not shown), each segment 22 is capable of slidably receiving an at least one external weight about an outer surface 44 of the segment 22, similar to that of a barbell. In such embodiments, where one or more weighted materials and/or objects are able to be selectively added to a given segment 22, the segment 22 may be constructed of a relatively lighter-weight material—or combination of materials—in at least one embodiment, such as plastic for example. In still further embodiments, each of the segments 22 may achieve an appropriate weight using any other means, now known or later developed, capable of allowing the system 20 to substantially carry out the functionality described herein.

Given that each segment 22 has a given weight and is capable of being engaged with other segments 22 in combination with at least one handle link 24, in at least one embodiment, the resulting exercise structure 26 is able to incorporate segments 22 of either equal weights (thereby creating a substantially uniform distribution of weight across the exercise structure 26) or differing weights (thereby creating an unbalanced exercise structure 26, which can be beneficial when performing certain exercises). Relatedly, in at least one embodiment where the weight of each of the segments 22 cannot be selectively modified by the user 30, each of the segments 22 provides a weight indicia (not shown) for indicating the approximate weight of that segment 22, in order to assist the user 30 in identifying and selecting segments 22 having desired weights. In at least one such embodiment, the weight indicia is an at least one color, or combination of colors, applied to at least a portion of the outer surface 44 of each segment 22, the particular colors being indicative of the weight of the associated segment 22 on which each color is applied. For example, in at least one embodiment, a blue-colored weight indicia may indicate that the segment 22 is five pounds, a yellow-colored weight indicia may indicate that the segment 22 is ten pounds, and a red-colored weight indicia may indicate that the segment 22 is fifteen pounds. In at least one such embodiment, the colored weight indicia may be applied to the outer surface 44 of the segment 22 directly, such as through painting the segment 22, for example. In at least one further embodiment, the colored weight indicia may be applied to the outer surface 44 of the segment 22 by coating the segment 22 in a colored material, such as rubber, plastic or foam for example. In still further embodiments, the colored weight indicia may be applied to the outer surface 44 of the segments 22 using any other methods and/or materials, now known or later developed. In still further embodiments, the weight indicia is a number representing the weight of the segment 22. In still further embodiments, any other type or form of indicia, now known or later conceived, capable of indicating the approximate weight of a given segment 22, may be utilized.

In at least one embodiment, the system 20 provides a variety of interchangeable handle links 24 of different sizes and configurations, each handle link 24 capable of being removably engaged with at least one of the segments 22 in series for creating exercise structures 26 consisting of various combinations of handle links 24 and segments 22 which, in turn, allow the user 30 to perform various fitness-related exercises. In a bit more detail, in at least one embodiment, as best shown in FIG. 1, each of the handle links 24 is an elongate handle bar 46 sized for accommodating the user's hand 28. Accordingly, in at least one such embodiment, when such handle links 24 are engaged with the segments 22 in series so as to form a ring-shaped exercise structure 26, the user 30 is capable of performing a variety of exercises. For example, while grasping the handle bars 46 and holding the exercise structure 26 around their waist 32, over their head 48, or out in front of them, the user 30 may perform trunk twists, chops, side dips, lunges, lateral twists, sit-ups, squats, step-ups, arm curls, chin raises, shoulder presses, tricep raises, burpies, squat jumps, bent-over rows, or any other exercises, now known or later developed, that could benefit from incorporating the exercise structure 26 having such handle links 24.

Figure 5:
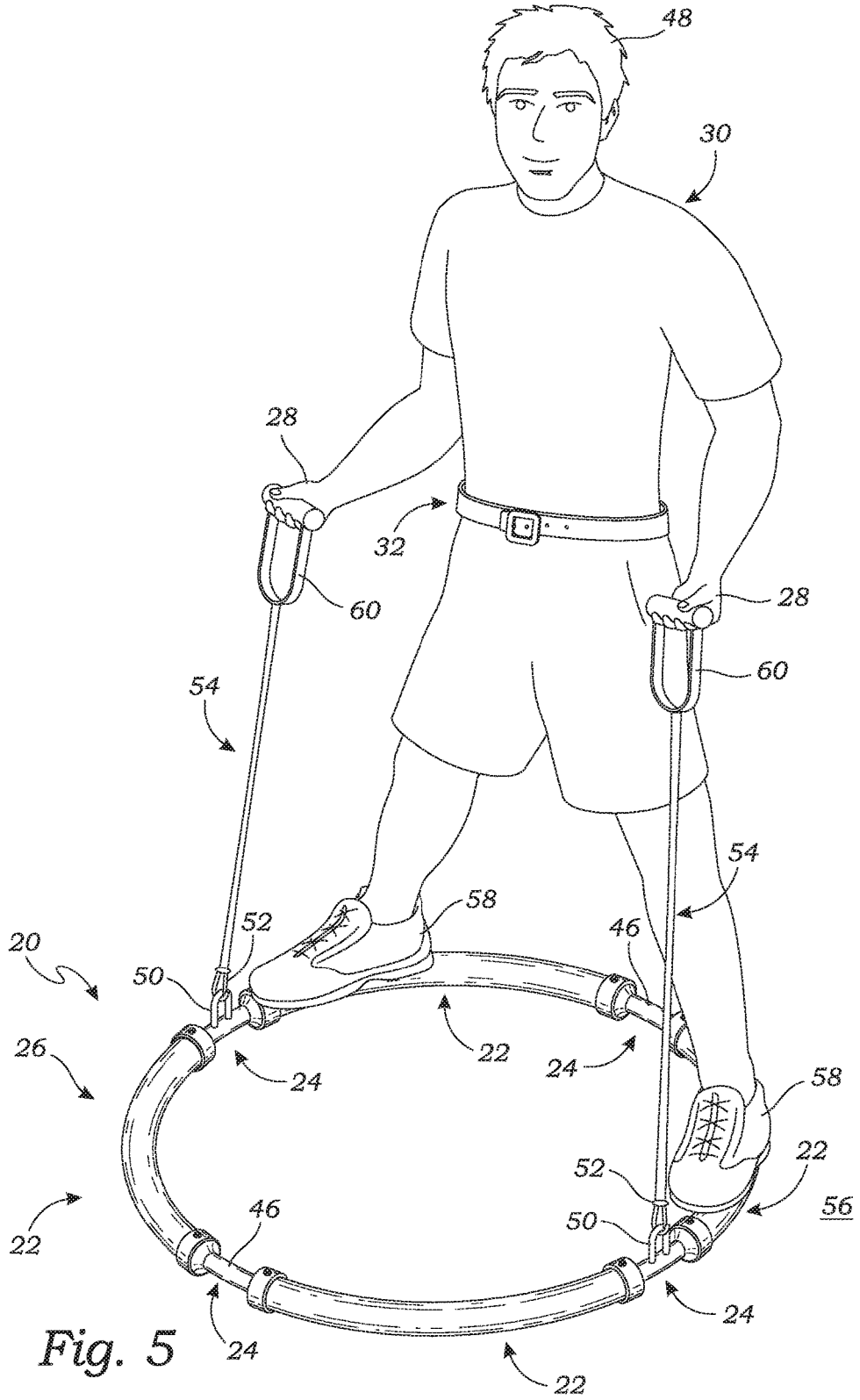
FIGS. 5 and 6 are perspective views of a user engaging in fitness-related exercises using the exemplary modular fitness system, in accordance with at least one embodiment.

In at least one embodiment, as best shown in FIG. 5, another type of handle link 24 provides an attachment point 50 configured for removable engagement with an end 52 of an at least one elastic resistance band 54. The attachment point 50 may be a hook, carabiner, or any other structure or mechanism, now known or later developed, capable of removable engagement with the resistance band 54. In at least one further embodiment, the end 52 of the resistance band 54 is permanently secured to the attachment point 50. Accordingly, in at least one such embodiment, when such handle links 24 are engaged with the segments 22 in series, the user 30 is capable of positioning the exercise structure 26 on the ground 56 (or a similar surface), placing an appropriate amount of weight on the exercise structure 26 (i.e., at least one foot 58 on the exercise structure 26, seated on the exercise structure 26, laying on the exercise structure 26, placing a weighted object on the exercise structure 26, etc.) to prevent the exercise structure 26 from unintentionally moving out of position on the ground 56, grasping a free end 60 of the at least one resistance band 54, and performing a variety of exercises, including but not limited to arm curls, squats, bent-over rows, seated rows, lying pullovers, incline chest presses, overhead presses, forward raises, lateral raises, tricep raises, or any other resistance band exercises, now known or later developed, that could benefit from incorporating the exercise structure 26 having such handle links 24.

Figure 4:
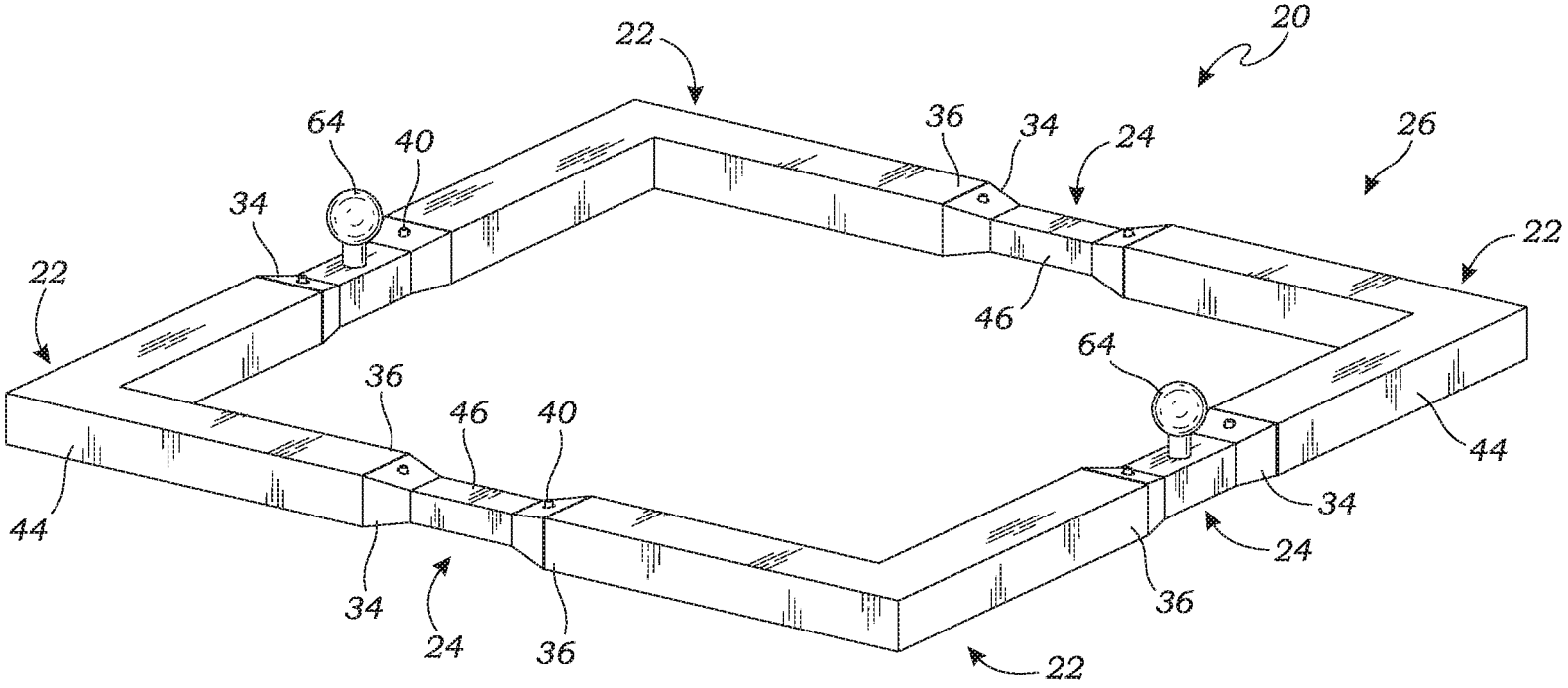
FIG. 4 is a perspective view of a further exemplary modular fitness system, in accordance with at least one embodiment.
Figure 7:
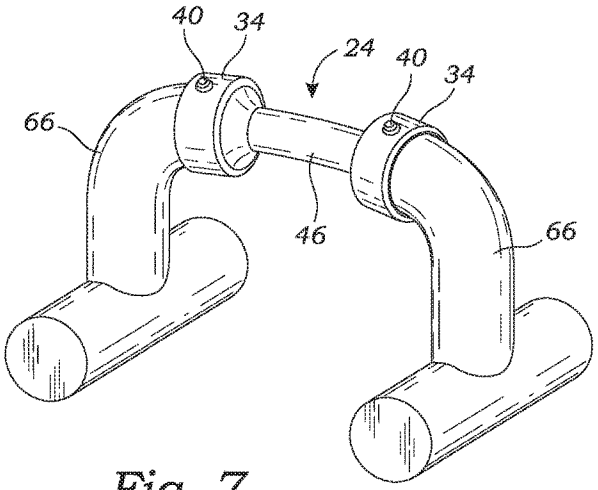
FIG. 7 is a perspective view of exemplary push-up attachments for use with an at least one handle link, in accordance with at least one embodiment.
Figure 6:
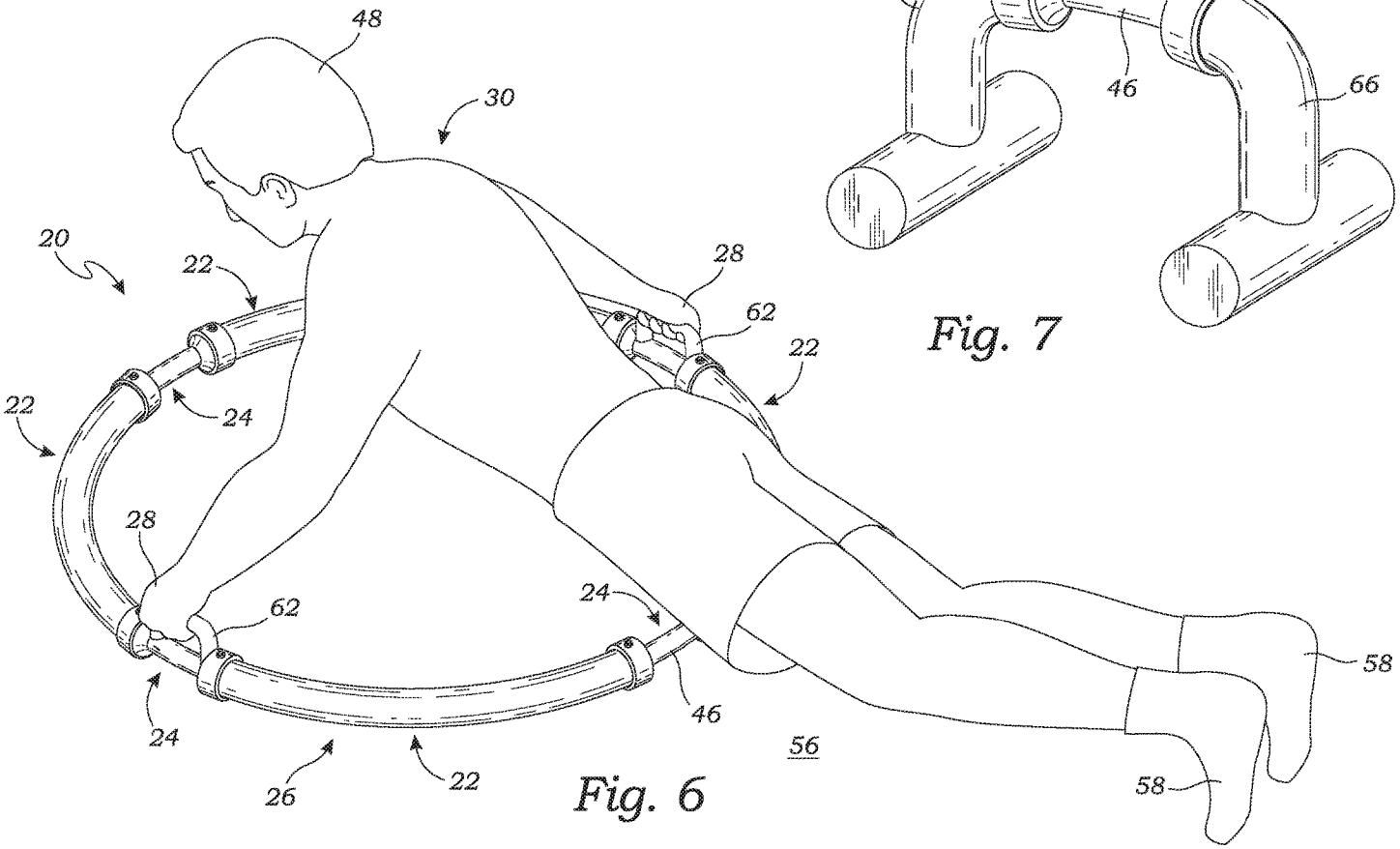

In at least one embodiment, as best shown in FIG. 6, another type of handle link 24 provides an elevated handle bar 62 that allows the handle link 24 to be grasped by the user's hand 28 while the exercise structure 26 is positioned on the ground 56 (or a similar surface). Accordingly, in at least one such embodiment, with the exercise structure 26 providing two such opposing handle links 24 that incorporate the elevated handle bar 62, the user 30 is able to perform push-ups, or any other exercises, now known or later developed, that could benefit from incorporating the exercise structure 26 having such handle links 24. Relatedly, in at least one embodiment, as best shown in FIG. 4, another type of handle link 24 provides an elevated ball grip 64 that allows the handle link 24 to be grasped by the user's hand 28 while the exercise structure 26 is positioned on the ground 56 (or a similar surface), thereby enabling the user 30 to perform similar exercises as when the exercise structure 26 incorporates handle links 24 having the elevated handle bar 62. In at least one still further embodiment, as shown in FIG. 7, the handle link 24 is removably engagable with a pair of push-up feet 66 configured for elevating the handle link 24 a distance above the ground 56 (or a similar surface) on which the push-up feet 66 are positioned, thereby allowing the handle link 24 to be grasped by the user's hand 28. In at least one embodiment, the push-up feet 66 incorporate the same engagement mechanism 38 as the segments 22. Accordingly, in at least one such embodiment, a pair of such handle links 24 may be used to perform push-ups or any other exercises, now known or later developed, that could benefit from incorporating such handle links 24. It should be noted that the particular configuration of the push-up feet 66 shown in FIG. 7 is merely exemplary; thus, in further such embodiments, the push-up feet 66 may take on any other size, shape, or configuration—now known or later developed—capable of being removably engaged with the opposing handle ends 34 of the handle link 24 so as to elevate the handle link 24 a distance above the ground 56 and support the weight of the user 30.

While FIGS. 1-6 show the exercise structure 26 as being substantially ring-shaped, it should be noted that the exercise structure 26 may selectively take on any number of non-ring-shaped configurations as well—depending, in part, on the particular exercises that the user 30 desires to perform. Select non-limiting examples of such non-ring-shaped configurations are illustrated in FIGS. 8-10.

Figure 8:
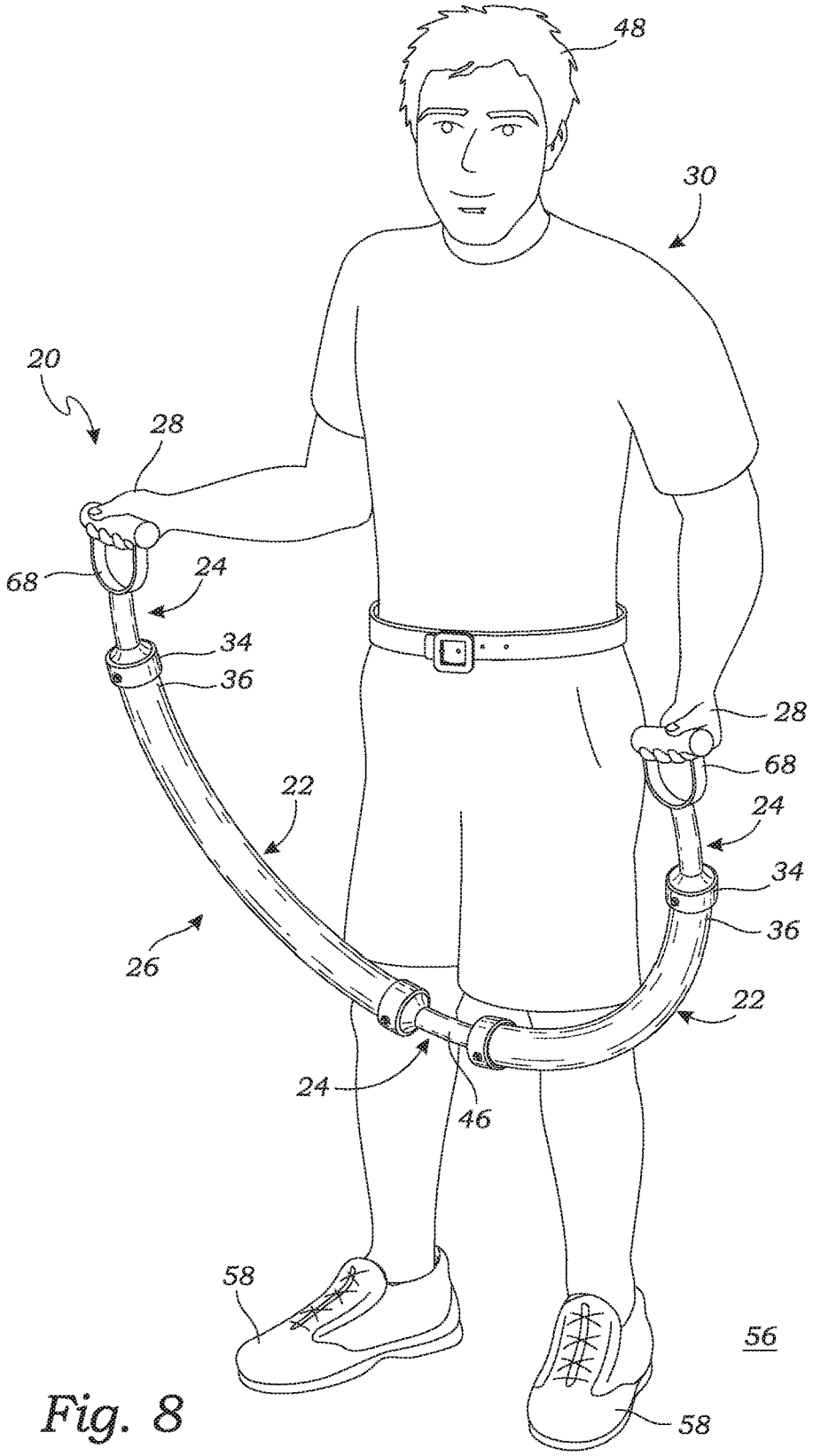
FIGS. 8-10 are perspective views of the user engaging in further fitness-related exercises using the exemplary modular fitness system, in accordance with at least one embodiment.
Figure 9:
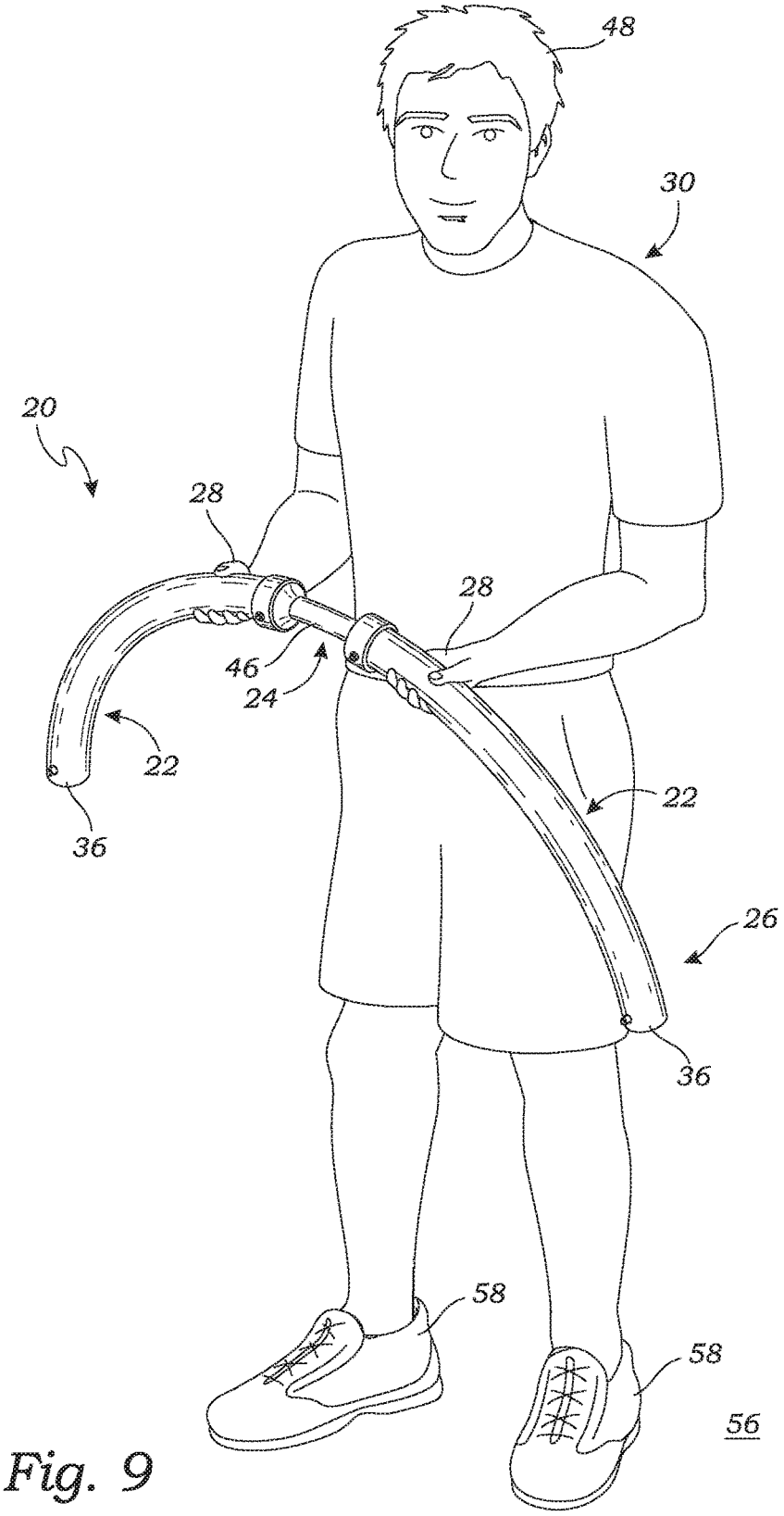

In at least one embodiment, as best shown in FIGS. 8 and 9, the segments 22 and handle links 24 may be engaged in series so as to form a substantially semi-circular-shaped exercise structure 26. Accordingly, in at least one embodiment, depending on the particular types of handle links 24 being used, the user 30 may grasp either the handle links 24 (FIG. 8) or segments 22 (FIG. 9) and perform a variety of exercises, including but not limited to arm curls, squats, overhead presses, forward raises, lateral raises, tricep raises, or any other exercises, now known or later developed, that could benefit from incorporating the exercise structure 26 having such handle links 24. In at least one such embodiment, as illustrated in FIG. 8, another type of handle link 24 provides a stirrup handle 68, which can assist in performing at least some of the possible exercises while the exercise structure 26 is in a semi-circular-shaped configuration (among other configurations). This particular handle link 24 is also an example of a handle link 24 that has only one handle end 34 capable of removable engagement with one of the segment ends 36.

Figure 10:
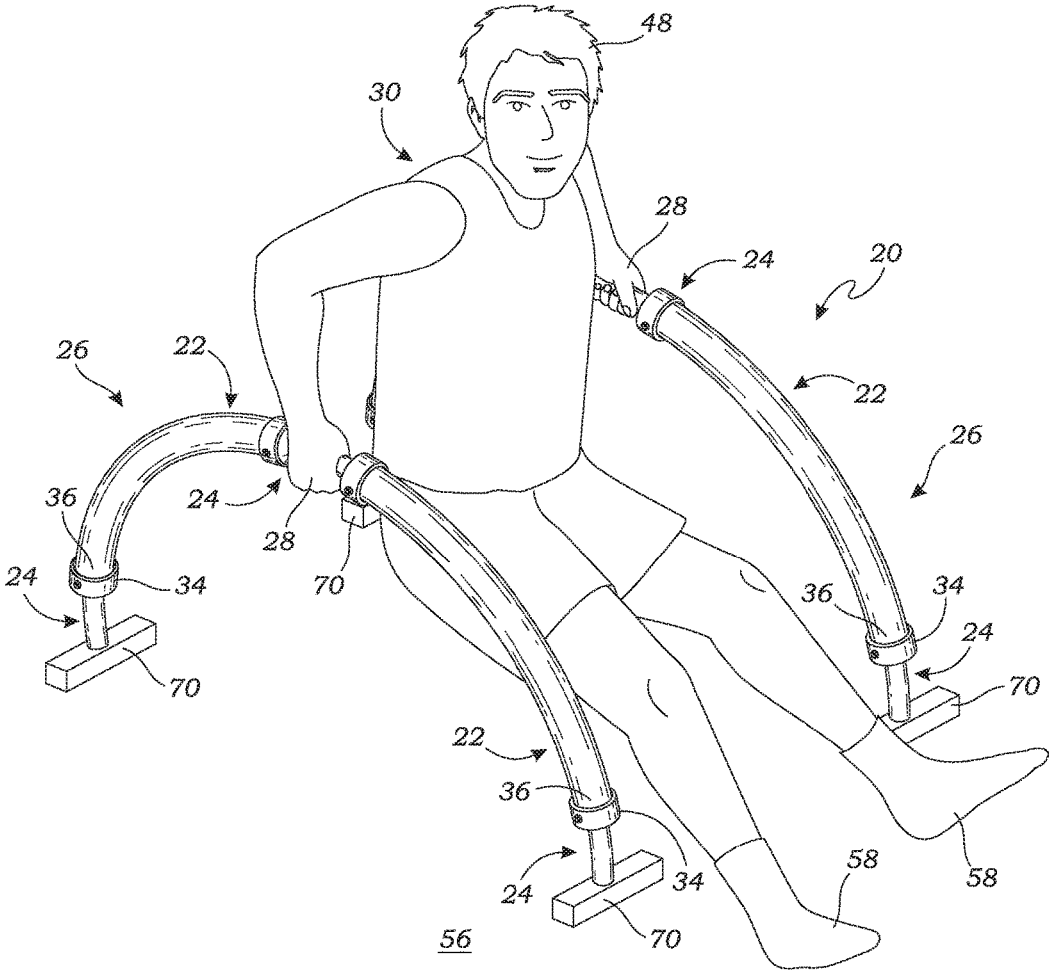

In at least one embodiment, as best shown in FIG. 10, the segments 22 and handle links 24 may be engaged in series so as to form a pair of substantially semi-circular-shaped exercise structures 26. Additionally, opposing segment ends 36 of each of the exercise structures 26 are removably engagable with handle links 24 that provide a stabilizing foot 70, thereby allowing each of the exercise structures 26 to be positioned on the ground 56 (or a similar surface) in a substantially vertical orientation. Accordingly, in at least one embodiment, with the exercise structures 26 so positioned on the ground 56, substantially parallel with and spaced apart from one another, and the user 30 positioned therebetween, the user 30 is able to grasp either the handle links 24 or segments 22 (depending on the particular arrangement of handle links 24 and segments 22) and perform a variety of exercises, including but not limited to bar dips or any other exercises, now known or later developed, that could benefit from incorporating the exercise structure 26 having such handle links 24. It should be noted that the particular configuration of the stabilizing foot 70 shown in FIG. 10 is merely exemplary; thus, in further such embodiments, the stabilizing foot 70 may take on any other size, shape, or configuration—now known or later developed—capable of being removably engaged with the segment end 36 of one of the segments 22 so as to allow the exercise structure 26 to be positioned on the ground 56 in a substantially vertical orientation and assist in supporting the weight of the user 30.

It should be noted that the particular types of handle links 24 shown and described herein are merely exemplary, and the present invention should not be read as being so limited.

In further embodiments, the handle links 24 may take on any other size, shape, or configuration—now known or later developed—capable of being removably engagable with at least one of the segments 22 in series for assisting the user 30 in performing one or more fitness-related exercises.

Aspects of the present specification may also be described as follows:

1. A modular fitness system comprising: a plurality of elongate weighted segments; a plurality of handle links sized and configured for accommodating a hand of a user; and the segments and handle links removably engagable with one another in series so as to form an exercise structure; whereby, the user is capable of selectively engaging at least one of the segments having a desired weight with at least one of the handle links in order to form an appropriate configuration of the exercise structure for performing one or more desired exercises therewith.

2. The modular fitness system according to embodiment 1, wherein: each segment provides opposing segment ends; and each handle link provides an at least one handle end removably engagable with the segment end of one of the segments.

3. The modular fitness system according to embodiments 1-2, wherein each handle end is open and sized for approximating an outer diameter of the segment end of one of the segments, thereby allowing the segment end to be selectively inserted within the handle end.

4. The modular fitness system according to embodiments 1-3, wherein the handle ends and segment ends provide complementary engagement mechanisms for preventing the handle ends and corresponding segment ends from being unintentionally disengaged from one another.

5. The modular fitness system according to embodiments 1-4, wherein the engagement mechanisms comprise an at least one spring-biased pin positioned within each segment end and configured for selectively indexing into a corresponding at least one pin aperture positioned on each handle end.

6. The modular fitness system according to embodiments 1-5, wherein each of the segments is constructed of at least one of metal, steel, lead, and iron.

7. The modular fitness system according to embodiments 1-6, wherein each of the segments is at least partially hollow and configured for receiving a weighted material.

8. The modular fitness system according to embodiments 1-7, wherein the weighted material is removably received within each of the segments for allowing the user to selectively increase or decrease the weight of the segments as desired.

9. The modular fitness system according to embodiments 1-8, wherein each of the segments provides a weight indicia for indicating an approximate weight of said segment in order to assist the user in identifying and selecting segments having desired weights.

10. The modular fitness system according to embodiments 1-9, wherein the weight indicia is an at least one color applied to at least a portion of an outer surface of each segment, the at least one color being indicative of the weight of the associated segment on which said color is applied.

11. The modular fitness system according to embodiments 1-10, further comprising a variety of interchangeable handle links of different sizes and configurations, each said handle link capable of being selectively engaged with at least one of the segments in series in order to form an appropriate configuration of the exercise structure for performing one or more desired exercises therewith.

12. The modular fitness system according to embodiments 1-11, wherein the segments and handle links are sized and shaped for being selectively engaged with one another in series such that the resulting exercise structure is substantially ring-shaped.

13. The modular fitness system according to embodiments 1-12, wherein the ring-shaped exercise structure is sized for allowing the user to grasp opposing handle links and hold the exercise structure substantially around a waist of the user.

14. The modular fitness system according to embodiments 1-13, wherein the system comprises a set of four segments and four handle links.

15. The modular fitness system comprising: a plurality of elongate weighted segments, each segment providing opposing segment ends; a plurality of handle links sized and configured for accommodating a hand of a user, each handle link providing an at least one handle end; the segment ends and handle ends removably engagable with one another in alternating series so as to form a substantially ring-shaped exercise structure sized for allowing the user to grasp opposing handle links and hold the exercise structure substantially around a waist of the user; whereby, the user is capable of selectively engaging at least one of the segments having a desired weight with at least one of the handle links in order to form an appropriate configuration of the exercise structure for performing one or more desired exercises therewith.

16. A modular fitness system comprising: a plurality of elongate weighted segments, each segment providing opposing segment ends; a plurality of handle links sized and configured for accommodating a hand of a user, each handle link providing an at least one handle end; the segment ends and handle ends removably engagable with one another in alternating series so as to form a substantially ring-shaped exercise structure sized for allowing the user to grasp opposing handle links and hold the exercise structure substantially around a waist of the user; and the segment ends and handle ends providing complementary engagement mechanisms for preventing the handle ends and corresponding segment ends from being unintentionally disengaged from one another; whereby, the user is capable of selectively engaging at least one of the segments having a desired weight with at least one of the handle links in order to form an appropriate configuration of the exercise structure for performing one or more desired exercises therewith.

In closing, regarding the exemplary embodiments of the present invention as shown and described herein, it will be appreciated that a modular fitness system, and associated methods of use, is disclosed and capable of being selectively arranged and configured for allowing a user to engage in a wide variety of fitness-related exercises. Because the principles of the invention may be practiced in a number of configurations beyond those shown and described, it is to be understood that the invention is not in any way limited by the exemplary embodiments, but is generally directed to a modular fitness system and is able to take numerous forms to do so without departing from the spirit and scope of the invention. It will also be appreciated by those skilled in the art that the present invention is not limited to the particular geometries and materials of construction disclosed, but may instead entail other functionally comparable structures or materials, now known or later developed, without departing from the spirit and scope of the invention. Furthermore, the various features of each of the above-described embodiments may be combined in any logical manner and are intended to be included within the scope of the present invention.

Groupings of alternative embodiments, elements, or steps of the present invention are not to be construed as limitations. Each group member may be referred to and claimed individually or in any combination with other group members disclosed herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Unless otherwise indicated, all numbers expressing a characteristic, item, quantity, parameter, property, term, and so forth used in the present specification and claims are to be understood as being modified in all instances by the term "about." As used herein, the term "about" means that the characteristic, item, quantity, parameter, property, or term so qualified encompasses a range of plus or minus ten percent above and below the value of the stated characteristic, item, quantity, parameter, property, or term. Accordingly, unless indicated to the contrary, the numerical parameters set forth in the specification and attached claims are approximations that may vary. At the very least, and not as an attempt to limit the application of the doctrine of equivalents to the scope of the claims, each numerical indication should at least be construed in light of the number of reported significant digits and by applying ordinary rounding techniques. Notwithstanding that the numerical ranges and values setting forth the broad scope of the invention are approximations, the numerical ranges and values set forth in the specific examples are reported as precisely as possible. Any numerical range or value, however, inherently contains certain errors necessarily resulting from the standard deviation found in their respective testing measurements. Recitation of numerical ranges of values herein is merely intended to serve as a shorthand method of referring individually to each separate numerical value falling within the range. Unless otherwise indicated herein, each individual value of a numerical range is incorporated into the present specification as if it were individually recited herein.

The terms "a," "an," "the" and similar referents used in the context of describing the present invention (especially in the context of the following claims) are to be construed to cover both the singular and the plural, unless otherwise indicated herein or clearly contradicted by context. All methods described herein can be performed in any suitable order unless otherwise indicated herein or otherwise clearly contradicted by context. The use of any and all examples, or exemplary language (e.g., "such as") provided herein is intended merely to better illuminate the present invention and does not pose a limitation on the scope of the invention otherwise claimed. No language in the present specification should be construed as indicating any non-claimed element essential to the practice of the invention.

Specific embodiments disclosed herein may be further limited in the claims using consisting of or consisting essentially of language. When used in the claims, whether as filed or added per amendment, the transition term "consisting of" excludes any element, step, or ingredient not specified in the claims. The transition term "consisting essentially of" limits the scope of a claim to the specified materials or steps and those that do not materially affect the basic and novel characteristic(s). Embodiments of the present invention so claimed are inherently or expressly described and enabled herein.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. A modular fitness system comprising:

a plurality of elongate weighted segments;

a plurality of handle links sized and configured for accommodating a hand of a user; and the segments and handle links removably engagable with one another in series so as to form a substantially ring-shaped exercise structure;

whereby, the user is capable of selectively engaging at least one of the segments having a desired weight with at least one of the handle links in order to form an appropriate configuration of the exercise structure for performing one or more desired exercises therewith.

2. The modular fitness system of claim 1, wherein:

each segment provides opposing segment ends; and each handle link provides an at least one handle end removably engagable with the segment end of one of the segments.

3. The modular fitness system of claim 2, wherein each handle end is open and sized for approximating an outer diameter of the segment end of one of the segments, thereby allowing the segment end to be selectively inserted within the handle end.

4. The modular fitness system of claim 3, wherein the handle ends and segment ends provide complementary engagement mechanisms for preventing the handle ends and corresponding segment ends from being unintentionally disengaged from one another.

5. The modular fitness system of claim 4, wherein the engagement mechanisms comprise an at least one spring-biased pin positioned within each segment end and configured for selectively indexing into a corresponding at least one pin aperture positioned on each handle end.

6. The modular fitness system of claim 1, wherein each of the segments is constructed of at least one of metal, steel, lead, and iron.

7. The modular fitness system of claim 1, wherein each of the segments is at least partially hollow and configured for receiving a weighted material.

8. The modular fitness system of claim 7, wherein the weighted material is removably received within each of the segments for allowing the user to selectively increase or decrease the weight of the segments as desired.

9. The modular fitness system of claim 1, wherein each of the segments provides a weight indicia for indicating an approximate weight of said segment in order to assist the user in identifying and selecting segments having desired weights.

10. The modular fitness system of claim 9, wherein the weight indicia is an at least one color applied to at least a portion of an outer surface of each segment, the at least one color being indicative of the weight of the associated segment on which said color is applied.

11. The modular fitness system of claim 1, further comprising a variety of interchangeable handle links of different sizes and configurations, each said handle link capable of being selectively engaged with at least one of the segments in series in order to form an appropriate configuration of the exercise structure for performing one or more desired exercises therewith.

12. The modular fitness system of claim 1, wherein the segments and handle links are sized and shaped for being selectively engaged with one another in series such that the resulting exercise structure is substantially ring-shaped.

13. The modular fitness system of claim 12, wherein the ring-shaped exercise structure is sized for allowing the user to grasp opposing handle links and hold the exercise structure substantially around a waist of the user.

14. The modular fitness system of claim 1, wherein the system comprises a set of four segments and four handle links.

15. A modular fitness system comprising:

a plurality of elongate weighted segments, each segment providing opposing segment ends;

a plurality of handle links sized and configured for accommodating a hand of a user, each handle link providing an at least one handle end;

the segment ends and handle ends removably engagable with one another in alternating series so as to form a substantially ring-shaped exercise structure sized for allowing the user to grasp opposing handle links and hold the exercise structure substantially around a waist of the user;

whereby, the user is capable of selectively engaging at least one of the segments having a desired weight with at least one of the handle links in order to form an appropriate configuration of the exercise structure for performing one or more desired exercises therewith.

16. A modular fitness system comprising:

a plurality of elongate weighted segments, each segment providing opposing segment ends;

a plurality of handle links sized and configured for accommodating a hand of a user, each handle link providing an at least one handle end;

the segment ends and handle ends removably engagable with one another in alternating series so as to form a substantially ring-shaped exercise structure sized for allowing the user to grasp opposing handle links and hold the exercise structure substantially around a waist of the user; and the segment ends and handle ends providing complementary engagement mechanisms for preventing the handle ends and corresponding segment ends from being unintentionally disengaged from one another;

whereby, the user is capable of selectively engaging at least one of the segments having a desired weight with at least one of the handle links in order to form an appropriate configuration of the exercise structure for performing one or more desired exercises therewith.

* * * * *